US010047696B2

(12) United States Patent
Goto

(10) Patent No.: US 10,047,696 B2
(45) Date of Patent: Aug. 14, 2018

(54) COVER STRUCTURE FOR INTERNAL COMBUSTION ENGINE

(71) Applicant: TOYOTA BOSHOKU KABUSHIKI KAISHA, Aichi-ken (JP)

(72) Inventor: Tatsuya Goto, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 37 days.

(21) Appl. No.: 15/273,081

(22) Filed: Sep. 22, 2016

(65) Prior Publication Data

US 2017/0101960 A1 Apr. 13, 2017

(30) Foreign Application Priority Data

Oct. 7, 2015 (JP) ..... 2015-199747

(51) Int. Cl.
*F02F 7/00* (2006.01)
*F02F 11/00* (2006.01)
*F01L 1/02* (2006.01)

(52) U.S. Cl.
CPC ..... *F02F 7/0073* (2013.01); *F01L 1/02* (2013.01); *F02F 11/00* (2013.01); *F02F 2007/0078* (2013.01)

(58) Field of Classification Search
CPC ..... F02F 7/0073; F02F 2007/0075; F02F 2007/0078; F02F 11/00; F01L 1/02; F01L 1/022; F01L 1/024; F01L 1/026
See application file for complete search history.

(56) References Cited

U.S. PATENT DOCUMENTS

2015/0096526 A1* 4/2015 Kurita ..... F02F 11/00 123/195 C

FOREIGN PATENT DOCUMENTS

JP 2015-71996 4/2015
JP 2015-102018 6/2015

* cited by examiner

*Primary Examiner* — Jacob Amick
(74) *Attorney, Agent, or Firm* — Greenblum & Bernstein, P.L.C.

(57) ABSTRACT

A cover structure for an internal combustion engine includes: a plastic cover member attached to a body of the internal combustion engine so as to cover the power transmission and a metallic holding member configured to hold an oil seal pressurized to the outer circumference of the crank shaft. Also, the holding member is positionable by engaging with the body of the internal combustion engine with respect to an axial direction of the crank shaft and a planar direction perpendicular to the axial direction. The cover member and the holding member are fastened together by a fastening bolt while interposing a gasket positioned to surround the crank shaft.

10 Claims, 15 Drawing Sheets

COVER STRUCTURE FOR INTERNAL COMBUSTION ENGINE

INCORPORATION BY REFERENCE

The present application claims priority under 35 U.S.C. § 119 of Japanese Application No. 2015-199747 filed on Oct. 7, 2015, the disclosure of which is expressly incorporated by reference herein in its entirety.

BACKGROUND

1. Technical Field

This invention relates to a cover structure for internal combustion engines. More particularly, this invention relates to a cover structure for an internal combustion engine for covering a power transmission configured to transmit the power from a crank shaft to a cam shaft in the internal combustion engine.

2. Related Art

According to a known cover structure for internal combustion engines, the cover structure covers a power transmission (e.g., a timing chain) configured to transmit the power from a crank shaft to a cam shaft in an internal combustion engine. For instance, a cover structure 110 includes, as depicted in FIG. 19, a metallic cover member 111 attached to a main body 102 (e.g., cylinder block) of an internal combustion engine so as to cover a power transmission 105. The cover member 111 has an insertion hole 118 for a crank shaft 103, and the internal circumference of the insertion hole 118 of the cover member 111 holds an oil seal 112 pressurized onto the outer circumference of the crank shaft 103. However, since the cover structure 110 employs the cover member 111 made of a metal, the cover structure 110 has a greater weight. In order to reduce the weight, proposals have been made on a variety of cover structures for internal combustion engines where plastic cover members are employed (e.g., see JP-A-2015-102018 and JP-A-2015-071996).

JP-A-2015-102018 discloses a cover structure 210 having a plastic cover member 211 attached to a body 202 of an internal combustion engine so as to cover a power transmission (see, e.g., FIG. 20). In the above cover structure 210, the cover member 211 is provided with an insertion hole 218 for a crank shaft 203. The inner circumference of the insertion hole 218 of the cover member 211 holds an oil seal 212 pressurized to the outer circumference of the crank shaft 203, and the cover member 211 and the body 202 of the internal combustion engine are fastened by a fastening bolt 214. In this manner, the employment of the plastic cover member 211 contributes to the weight reduction, and the fastening bolt 214 suppresses the cover member 211 from being deformed by heat or the like.

On the other hand, JP-A-2015-071996 discloses a cover structure 310 having: a plastic cover member 311 attached to a body 302 of an internal combustion engine so as to cover a power transmission; and a metallic holding member 313 configured to hold an oil seal 312 pressurized to the outer circumference of the crank shaft 303 (see, e.g., FIG. 21). In this cover structure 310, the holding member 313 is fastened to the body 302 of the internal combustion engine by a fastening bolt 314 while partially covering the front side of the cover member 311. The cover member 311 and the holding member 313 sandwiches a gasket 345 positioned to surround the crank shaft 303. In this manner, the employment of the plastic cover member 311 and the metallic holding member 313 contributes to the weight reduction, and the metallic holding member 313 suppresses the cover member 311 from being deformed by heat or the like.

In the technique disclosed in JP-A-2015-102018, however, since the oil seal 212 is held by the inner circumference of the insertion hole 218 of the plastic cover member 211, it is difficult to meet the required dimension of the oil seal 212. More specifically, since the plastic cover member 211 is easily deformed in the radial direction of the crank shaft 203 due to a strained force, heat, pressure and creep of the oil seal 212, the sealing performance of the oil seal 212 is not sufficiently secured. Further, the fastening bolt 214 is difficult to be positioned in the neighborhood of the crank shaft, where the members such as a sprocket and pulley are centralized. In addition, another seal member 209 would be required to be positioned between the fastening bolt 214 and the cover member 211, which is also a hurdle for the positioning.

On the other hand, in the technique disclosed in JP-A-2015-071996, the gasket 345 located at an outer circumferential position is pressurized by bringing the metallic holding member 313 into contact with the plastic cover member 311. Thus, a dimensional tolerance is increased, and the compressibility of the gasket 345 is greatly varied. Further, the gasket 345 is positioned in the neighborhood of the oil seal 312. Since the gasket 345 is pressurized by the fastening bolt 314 located at an outer circumferential position, the gasket 345 is not sufficiently pressurized, and the gasket 345 does not exhibit sufficient sealing performance. Also, when the plastic cover member 311 is deformed by heat or pressure, the compressibility of the gasket 345 is reduced, which may lead to a leakage of oil. Moreover, the plastic cover member 311 is fastened to the body 302 of the internal combustion engine at a peripheral edge position, and then the metallic holding member 313 is fastened thereto at a peripheral edge position. Thus, the metallic holding member 313 has a greater size and a heavier weight.

SUMMARY

The embodiments of the present invention were made in view of the circumstances described above, with an object to provide a cover structure for an internal combustion engine capable of reducing the weight as well as securing the sufficient sealing performance of an oil seal and a gasket.

One aspect of the present embodiments provides a cover structure for an internal combustion engine, the cover structure covering a power transmission configured to transmit power from a crank shaft to a cam shaft in the internal combustion engine, the cover structure comprising: a plastic cover member attached to a body of the internal combustion engine so as to cover the power transmission and provided with an insertion hole for the crank shaft; and a metallic holding member configured to accept insertion of the crank shaft and to hold an oil seal pressurized to an outer circumference of the crank shaft, wherein the holding member is positionable by engaging with the body of the internal combustion engine with respect to an axial direction of the crank shaft and a planar direction perpendicular to the axial direction, and the cover member and the holding member are fastened together by a fastening bolt while interposing a gasket positioned to surround the crank shaft.

In a further aspect, the holding member may include: a tube configured to accept the insertion of the crank shaft and to hold the oil seal at an inner circumferential position; a flange provided to an outer circumference of the tube and fastened by the fastening bolt to an outer circumference of the insertion hole of the cover member; and a positioning portion extending from the flange and/or the tube in the axial direction of the crank shaft and engaging with the body of the internal combustion engine.

In a further aspect, the gasket may be sandwiched between the outer circumference of the insertion hole of the cover member and the flange of the holding member.

In a further aspect, the gasket may be sandwiched between the insertion hole of the cover member and the tube of the holding member inserted into the insertion hole.

In a further aspect, the tube may be inserted into the insertion hole of the cover member.

In a further aspect, the fastening bolt may include a plurality of fastening bolts positioned along a circumferential direction of the flange.

In a further aspect, the positioning portion may include a plurality of rod-shaped legs.

In a further aspect, a shaft of the fastening bolt may be inserted into a through hole penetrating through the holding member in the axial direction of the crank shaft, a thread provided at a distal end of the shaft may be screwed into a nut embedded in the cover member, and the gasket may be positioned at a position inner with respect to the fastening bolt in a radial direction of the crank shaft.

In a further aspect, a shaft of the fastening bolt may be inserted into a through hole penetrating through the cover member in the axial direction of the crank shaft, a thread provided at a distal end of the shaft may be screwed into a thread hole formed in the holding member, and the gasket may be positioned at a position outer with respect to the fastening bolt in a radial direction of the crank shaft.

In a further aspect, the cover member may include a projection projecting into an inside of the insertion hole to face or abut on the oil seal held by the holding member.

The cover structure for an internal combustion engine according to the embodiment includes: the plastic cover member attached to the body of the internal combustion engine so as to cover the power transmission and provided with the insertion hole for the crank shaft; and the metallic holding member configured to accept the insertion of the crank shaft and to hold the oil seal pressurized to the outer circumference of the crank shaft. The holding member is positionable by engaging with the body of the internal combustion engine with respect to the axial direction of the crank shaft and the planar direction perpendicular to the axial direction. Further, the cover member and the holding member are fastened together by the fastening bolt while interposing the gasket positioned to surround the crank shaft. According to the above configuration, as the plastic cover member and the metallic holding member are used in combination and the metallic holding member holds the portion for which the dimensional accuracy is required, the weight of the cover structure as a whole is reduced. Further, the oil seal is held by the metallic holding member, and the holding member is positioned with respect to the axial direction of the crank shaft and the planar direction perpendicular to the axial direction. Therefore, the configuration secures the sufficient sealing performance of the oil seal. Moreover, since the cover member and the holding member are directly fastened together by the fastening bolt, the gasket is sufficiently pressurized, and the cover member is prevented from being deformed due to creep, heat or pressure. Even if the cover member is deformed due to creep, heat or pressure, the gasket follows the deformation. As the result, the configuration secures the sufficient sealing performance of the gasket. Still further, irrespective of the position where the cover member and the holding member are fastened together by the fastening bolt, the engaging position for positioning the holding member with respect to the body of the internal combustion engine is suitably set. Therefore, even in the neighborhood of the crank shaft where the components such as sprocket and pulley are centralized, the holding member is positioned and disposed.

When the holding member includes the tube, the flange and the positioning portion, the metallic holding member reduces its size and weight, thereby further contributing to the weight reduction of the cover structure as a whole.

When the gasket is sandwiched between the outer circumference of the insertion hole of the cover member and the flange of the holding member, the gasket is positioned in a neighborhood of the fastening bolt. Therefore, the sealing performance of the gasket is further enhanced.

On the other hand, when the gasket is sandwiched between the insertion hole of the cover member and the tube of the holding member inserted through the insertion hole, the gasket forms the shaft sealing. Thus, the holding member and even the oil seal are easily centered at the center position due to the centering function of the gasket.

When the shaft of the fastening bolt is inserted into the through hole formed in the holding member, the thread is screwed into the nut embedded in the cover member and the gasket is positioned at a position inner with respect to the fastening bolt in the radial direction of the crank shaft, the gasket seals the portion between the cover member and the holding member without providing any separate sealing member between the fastening bolt and the cover member. Therefore, the gasket may further reduce its diameter.

When the shaft of the fastening bolt is inserted into the through hole formed in the cover member; the thread is screwed into the thread hole bored in the holding member; and the gasket is positioned at a position outer with respect to the fastening bolt in the radial direction of the crank shaft, the gasket seals the portion between the cover member and the holding member without providing any separate sealing member between the fastening bolt and the cover member. Further, there is no need to embed the nut into the cover member, and the workability is enhanced.

When the cover member includes the projection projecting into the inside of the insertion hole to face or abut on the oil seal held by the holding member, the projection prevents the disengagement of the oil seal from the holding member.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 6A depicts the holding member viewed from the front side while FIG. 6B depicts the holding member viewed from the back side;

FIG. 7A depicts the holding member before being attached to the engine body, FIG. 7B depicts the holding member attached to the engine body, and FIG. 7C depicts a cross section taken along a line a-a in FIG. 7B in an enlarged manner;

FIG. 10A depicts a gasket having a substantially I-shaped vertical cross section while FIG. 10B depicts a gasket having a substantially circular vertical cross section;

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

<Cover Structure for Internal Combustion Engine>

Figure 1:
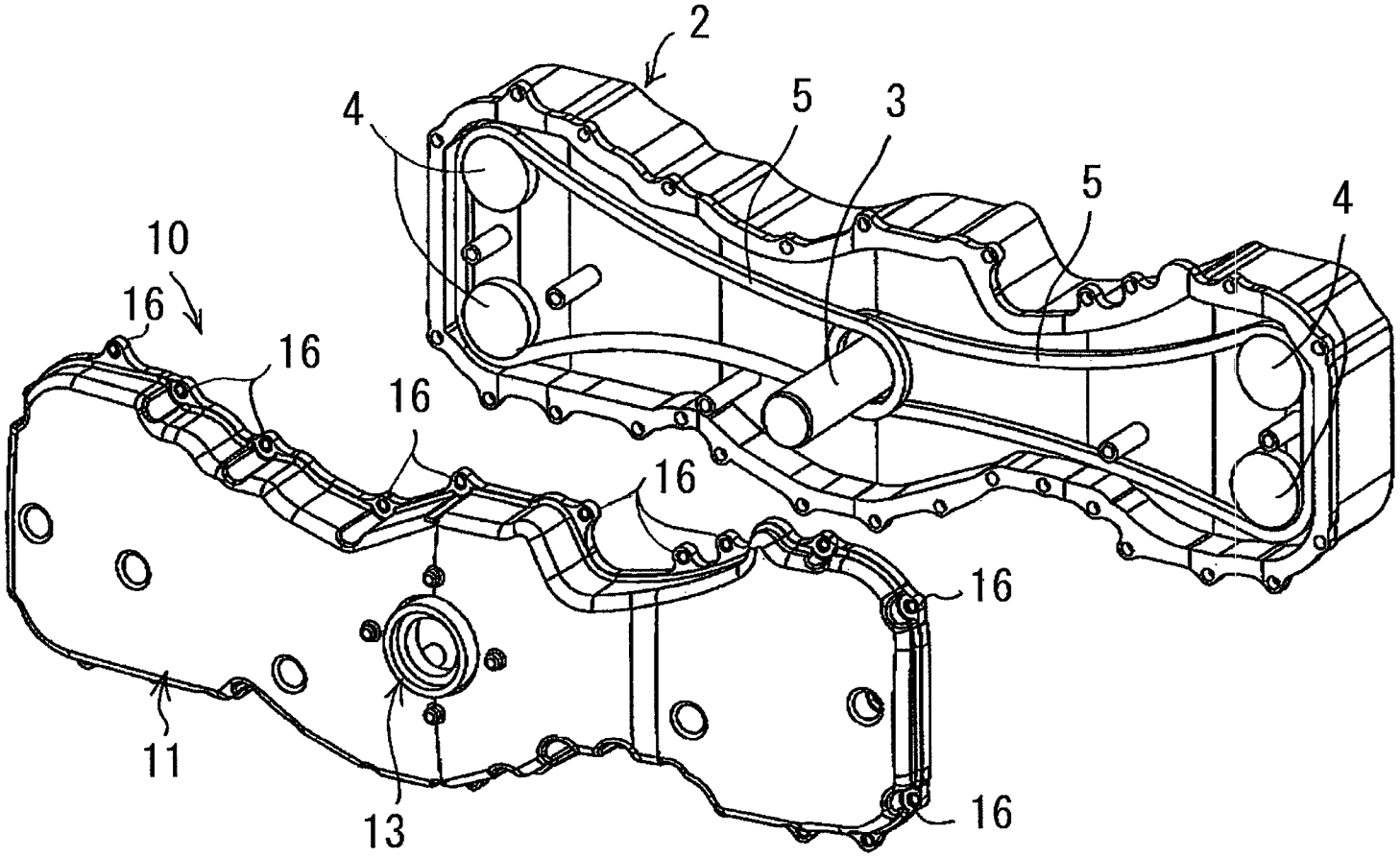
FIG. 1 is an exploded perspective view depicting a cover structure and an engine body of an engine according to Example 1.
Figure 7A:
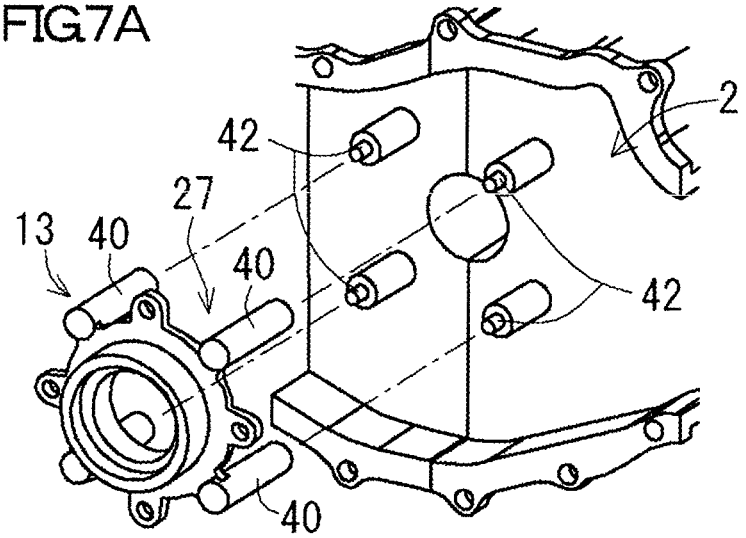
FIGS. 7A to 7C are for describing the positioning performance of the holding member, where
Figure 7B:
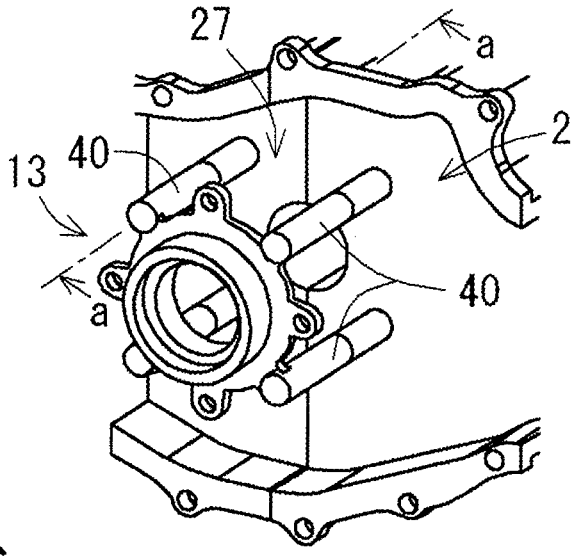
Figure 7C:
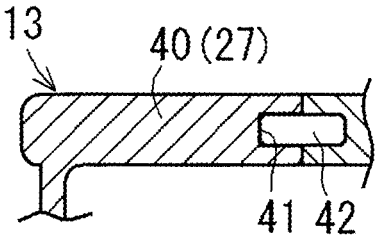

A cover structure for an internal combustion engine according to this embodiment is a cover structure (10, 10A, 10B) for an internal combustion engine, and the cover structure (10, 10A, 10B) covers a power transmission (5) configured to transmit the power from a crank shaft (3) to a cam shaft in the internal combustion engine (see, e.g., FIG. 1). The cover structure (10, 10A, 10B) includes: a plastic cover member (11, 11A, 11B) attached to a body (2) of the internal combustion engine so as to cover the power transmission (5) and provided with an insertion hole (18) for the crank shaft (3); and a metallic holding member (13, 13A, 13B) configured to accept the insertion of the crank shaft (3) and to hold an oil seal (12) pressurized to the outer circumference of the crank shaft (see, e.g., FIGS. 2, 11 and 14). Also, the holding member (13, 13A, 13B) is positionable by engaging with the body (2) of the internal combustion engine with respect to an axial direction of the crank shaft (3) and a planar direction perpendicular to the axial direction (see, e.g., FIGS. 7A to 7C). The cover member (11, 11A, 11B) and the holding member (13, 13A, 13B) are fastened together by a fastening bolt (37) while interposing a gasket (45, 45', 45") positioned to surround the crank shaft (3) (see, e.g., FIGS. 5, 13 and 16).

The fastening bolt is subject to no particular limitations, for instance, in terms of type, number, positioning layout, fastening direction or the like. The fastening bolt (37) may fasten, for instance, the cover member (11, 11B) from the back side (see, e.g., FIGS. 2 and 14), or may fasten the cover member (11A) from the front side (see, e.g., FIG. 11). The holding member (13, 13A) may be, for instance, attached to the cover member (11, 11A) from the back side (see, e.g., FIGS. 2 and 11), or the holding member (13B) may be attached to the cover member (11B) from the front side (see, e.g., FIG. 14).

The oil seal is subject to no particular limitation, for instance, in terms of configuration, material, shape or the like, as long as the oil seal seals the portion between the crank shaft and the holding member. Typically, the oil seal is annular. On the other hand, the gasket is also subject to no particular limitation, for instance, in terms of configuration, material, shape or the like, as long as the gasket seals the portion between the cover member and the holding member. Typically, the gasket is annular. Further, no particular limitation is required for the types of the plastic material for the cover member and the types of the metal material for the holding member.

In the cover structure for an internal combustion engine according to this embodiment, for instance, the holding member (13, 13A, 13B) may include: a tube (25, 25A, 25B) configured to accept the insertion of the crank shaft (3) and to hold the oil seal (12) at an inner circumferential position; a flange (26, 26A, 26B) provided to an outer circumference of the tube and fastened by the fastening bolt (37) to the outer circumference of the insertion hole (18) of the cover member (11, 11A, 11B); a positioning portion (27, 27A, 27B) extending from the flange and/or the tube in the axial direction of the crank shaft (3) and engaging with the body (2) of the internal combustion engine (see, e.g., FIG. 6).

Figure 5:
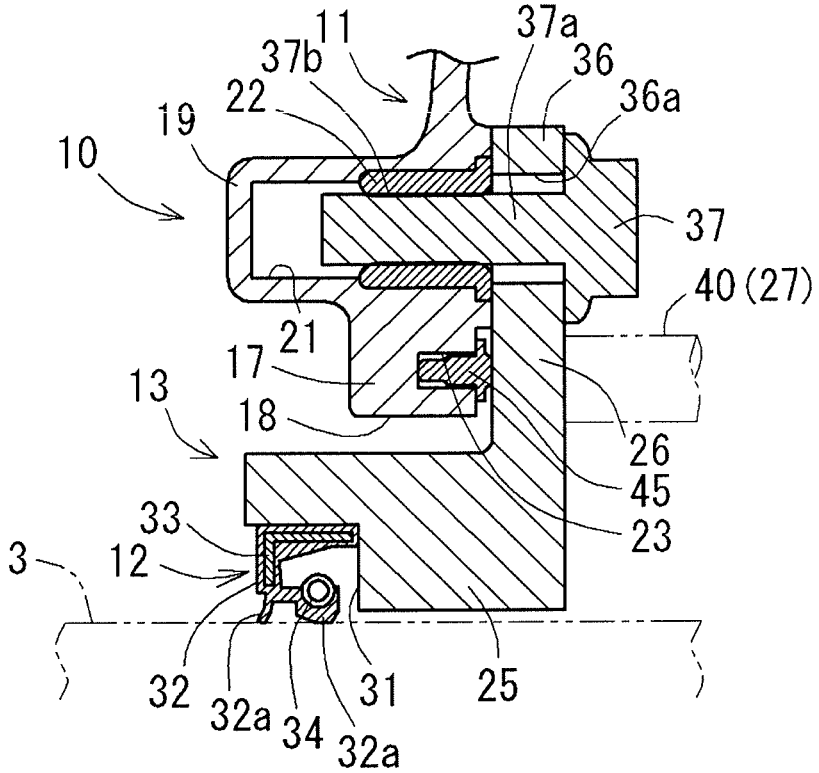
FIG. 5 is an enlarged view depicting a primary portion in FIG. 4.
Figure 13:
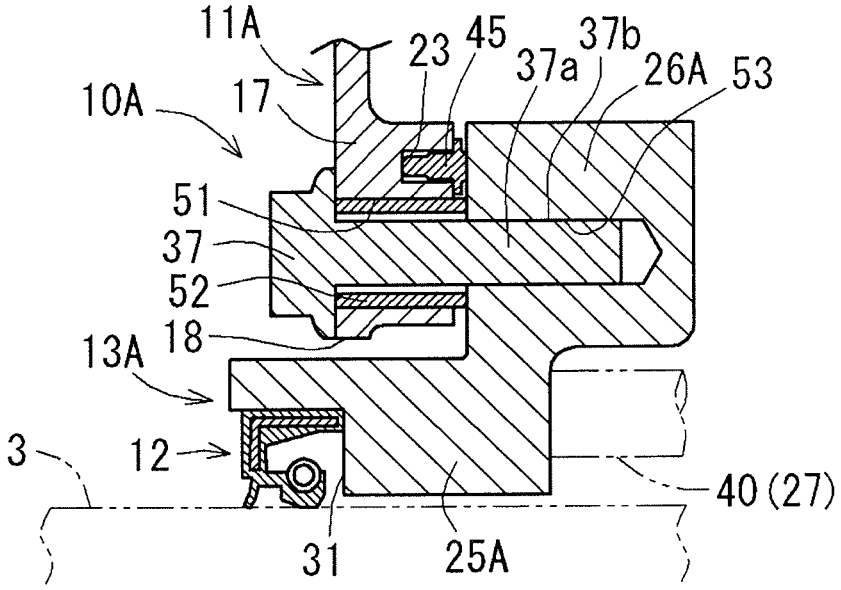
FIG. 13 is an enlarged view depicting a cross section taken along a line a-a in FIG. 12.
Figure 16:
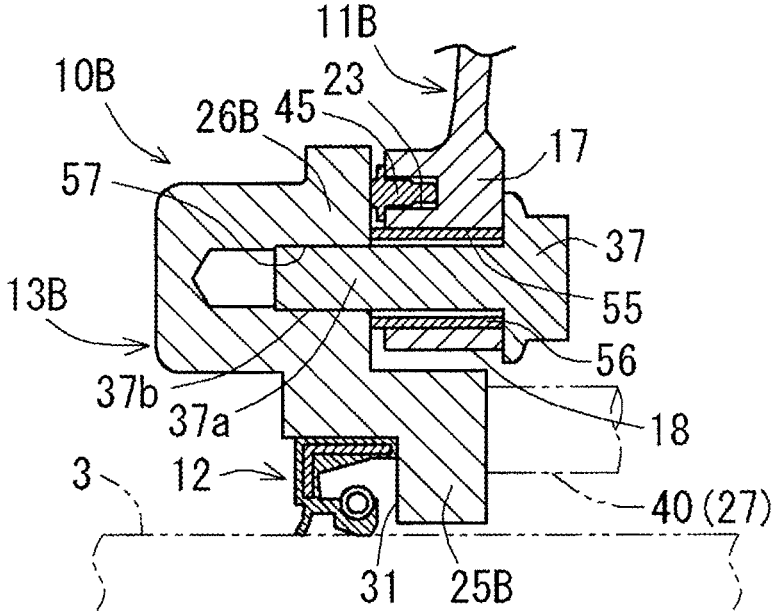
FIG. 16 is an enlarged view depicting a cross section taken along a line a-a in FIG. 15.

According to the embodiment described above, for instance, the gasket (45, 45', 45") may be sandwiched between the outer circumference of the insertion hole (18) of the cover member (11, 11A, 11B) and the flange (26, 26A, 26B) of the holding member (13, 13A, 13B) (see, e.g., FIGS. 5, 13 and 16).

Figure 17:
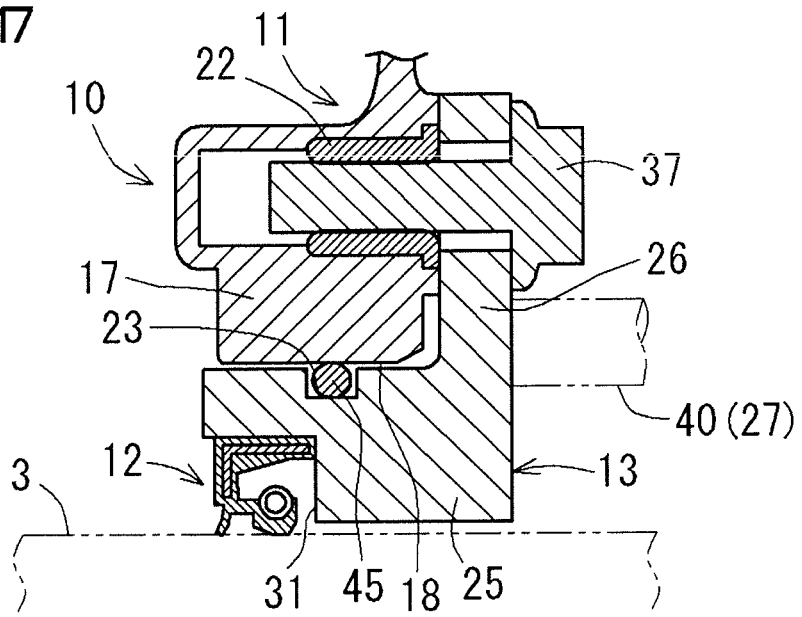
FIG. 17 is a vertical cross sectional view depicting a primary portion of a cover structure for an engine according to another embodiment.

In the above embodiment, for instance, the gasket (45, 45', 45") may be sandwiched between the insertion hole (18) of the cover member (11) and the tube (25) of the holding member (13) inserted into the insertion hole (see, e.g., FIG. 17).

In the above embodiment, for instance, the tube (25, 25A, 25B) may be inserted into the insertion hole (18) of the cover member (11, 11A, 11B) (see, e.g., FIGS. 5, 13 and 16). With this configuration, the holding member further reduces its size and weight, and the holding member is more easily fastened to the cover member by the fastening bolt.

Figure 2:
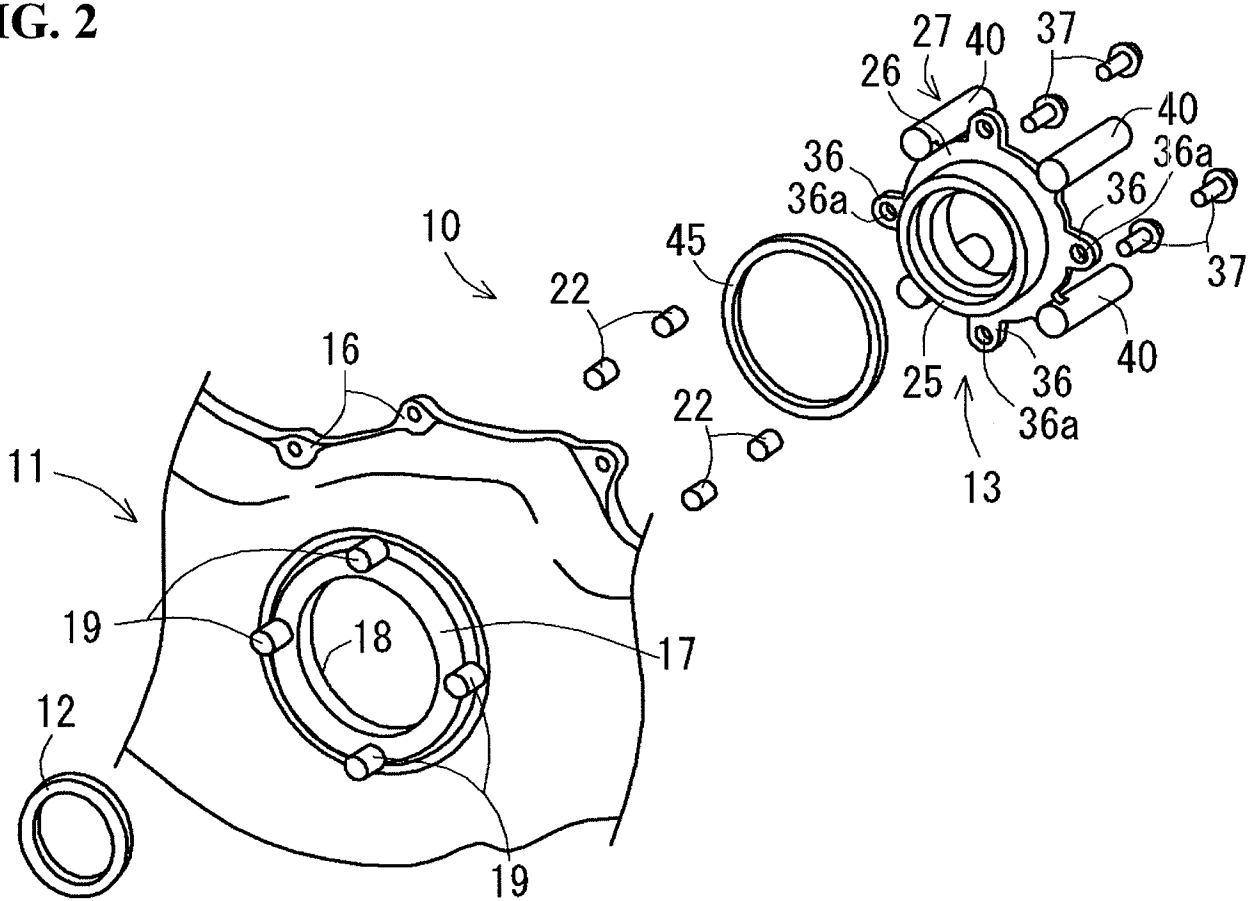
FIG. 2 is an exploded perspective view depicting a primary portion of the cover structure.
Figure 11:
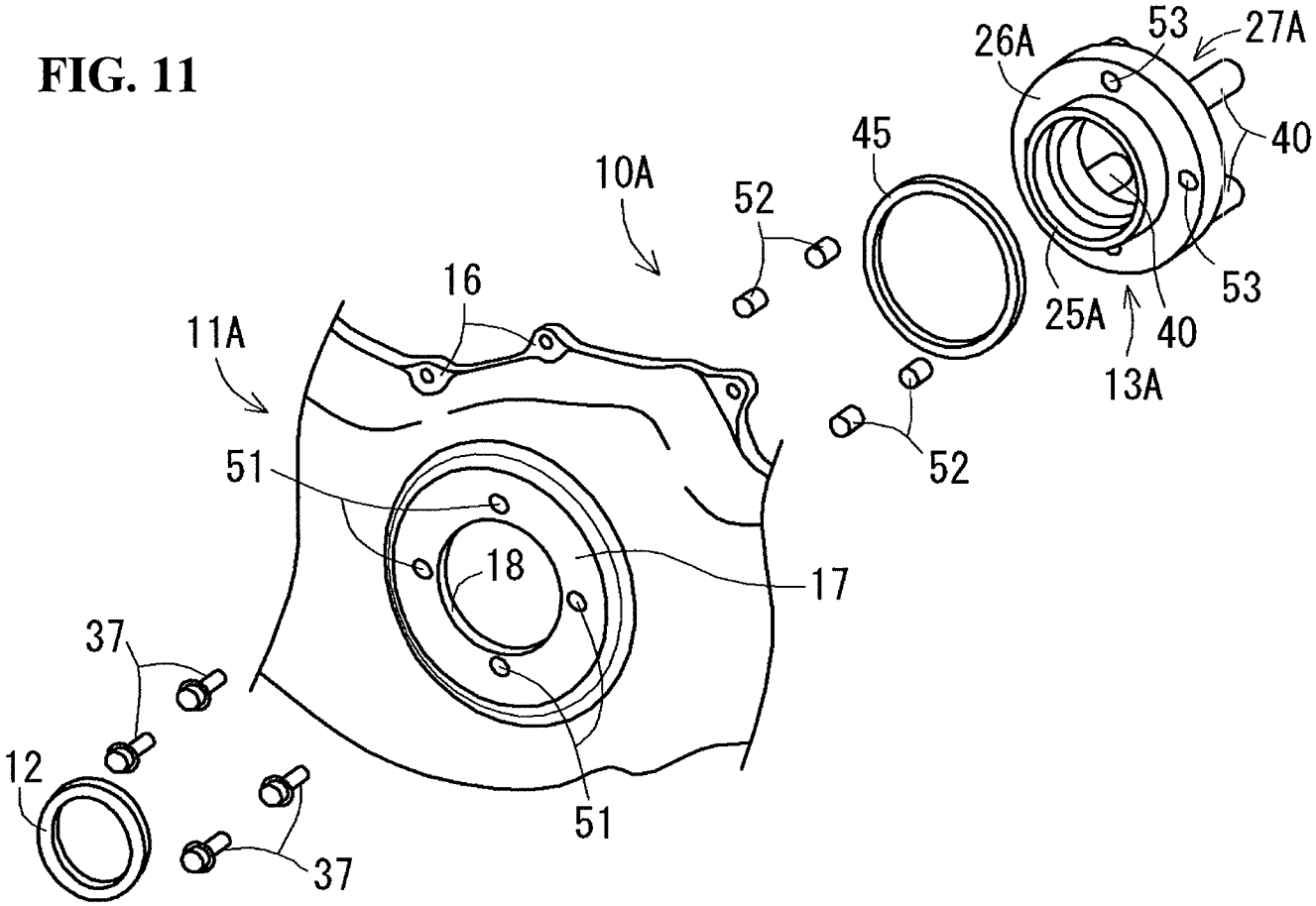
FIG. 11 is an exploded perspective view depicting a primary portion of the cover structure for an engine according to Example 2.
Figure 14:
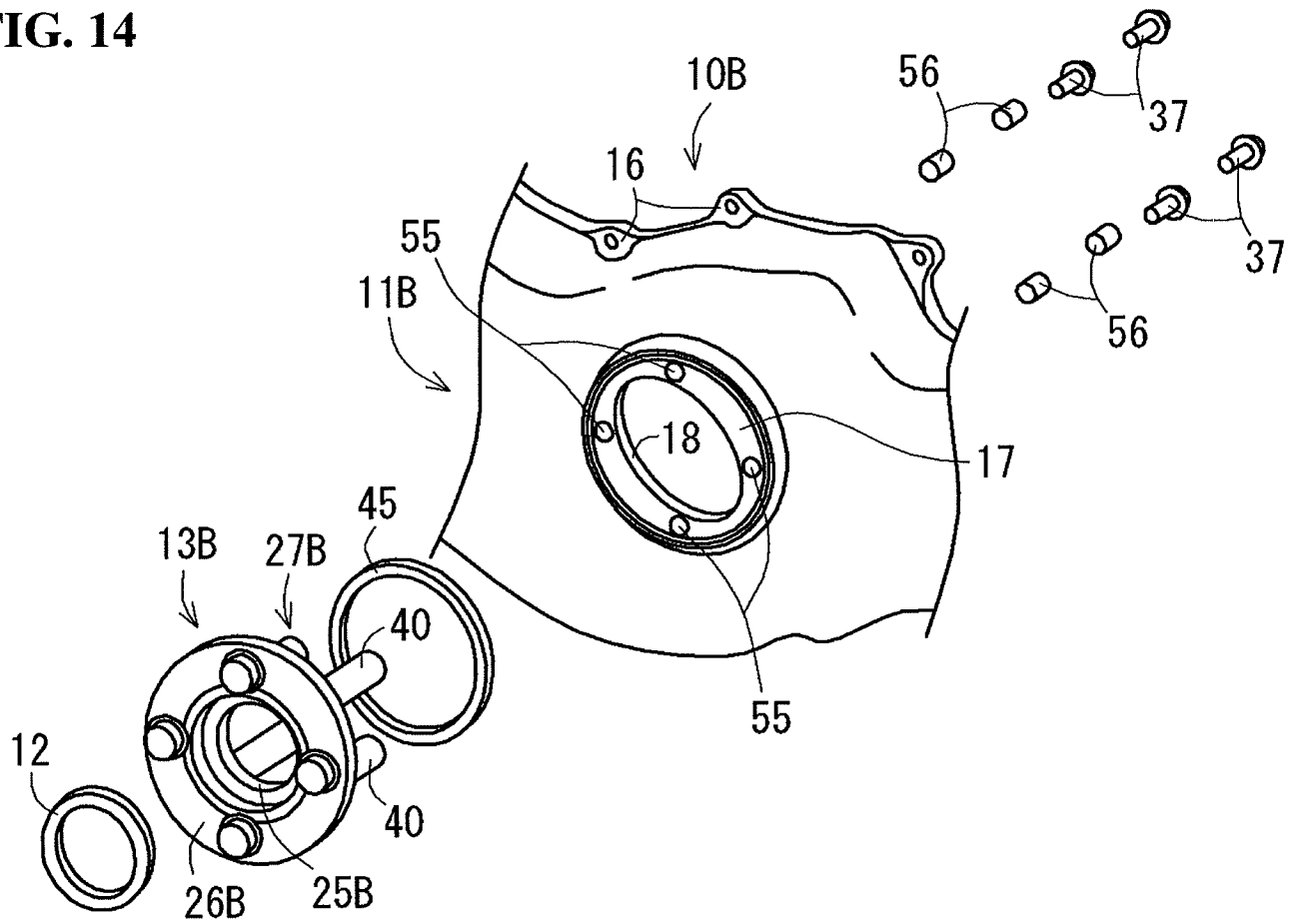
FIG. 14 is an exploded perspective view depicting a primary portion of the cover structure for an engine according to Example 3.

In the above embodiment, for instance, a plurality of fastening bolts (37) may be positioned along the circumference of the flange (26, 26A, 26B) at positions spaced apart from one another by an equal angle (see, e.g., FIGS. 2, 11 and 14). With this configuration, the gasket is substantially uniformly pressurized in the circumferential direction.

Figure 6A:
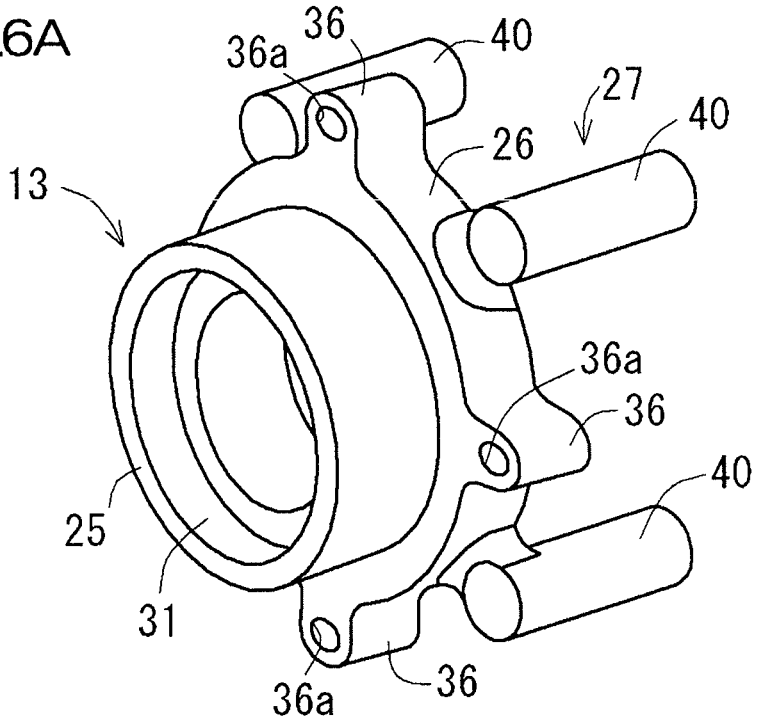
FIGS. 6A and 6B are perspective views depicting a holding member according to Example 1, where
Figure 6B:
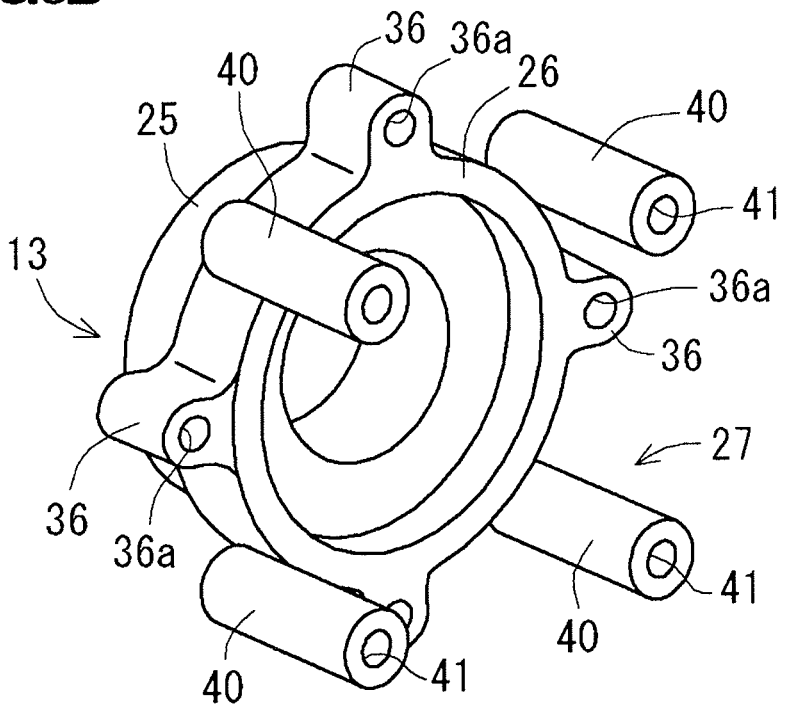

In the above embodiment, for instance, the positioning portion (27, 27A, 27B) may include a plurality of rod-shaped legs (40) (see, e.g., FIGS. 6A and 6B). With this configuration, the holding member further reduces its weight.

In the cover structure for an internal combustion engine according to this embodiment, for instance, a shaft (37*a*) of the fastening bolt (37) may be inserted into a through hole (36*a*) penetrating through the holding member (13) in the axial direction of the crank shaft (3), a thread (37*b*) formed at a distal end of the shaft (37*a*) may be screwed into a nut (22) embedded in the cover member (11), and the gasket (45, 45', 45") may be positioned at a position inner with respect to the fastening bolt (37) in the radial direction of the crank shaft (3) (see, e.g., FIG. 5).

In the cover structure for an internal engine according to this embodiment, for instance, the shaft (37*a*) of the fastening bolt (37) may be inserted into a through hole (51, 55) penetrating through the cover member (11A, 11B) in the axial direction of the crank shaft (3), the thread (37*b*) formed at the distal end of the shaft (37*a*) may be screwed into a thread hole (53, 57) formed in the holding member (13A, 13B), and the gasket (45, 45', 45") may be positioned at a position outer with respect to the fastening bolt (37) in the radial direction of the crank shaft (3) (see, e.g., FIGS. 13 and 16).

Figure 18:
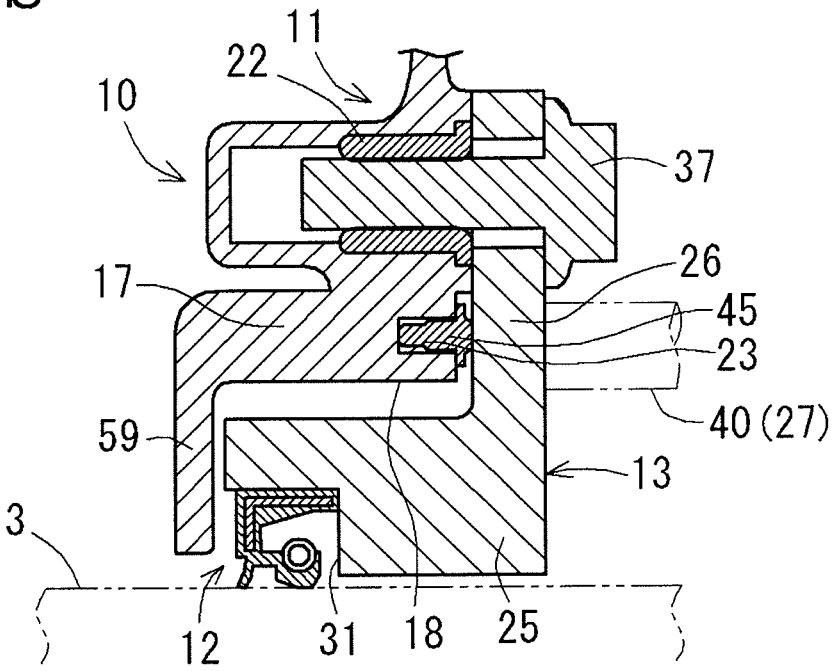
FIG. 18 is a vertical cross sectional view depicting a primary portion of a cover structure for an engine according to still another embodiment.
Figure 19:
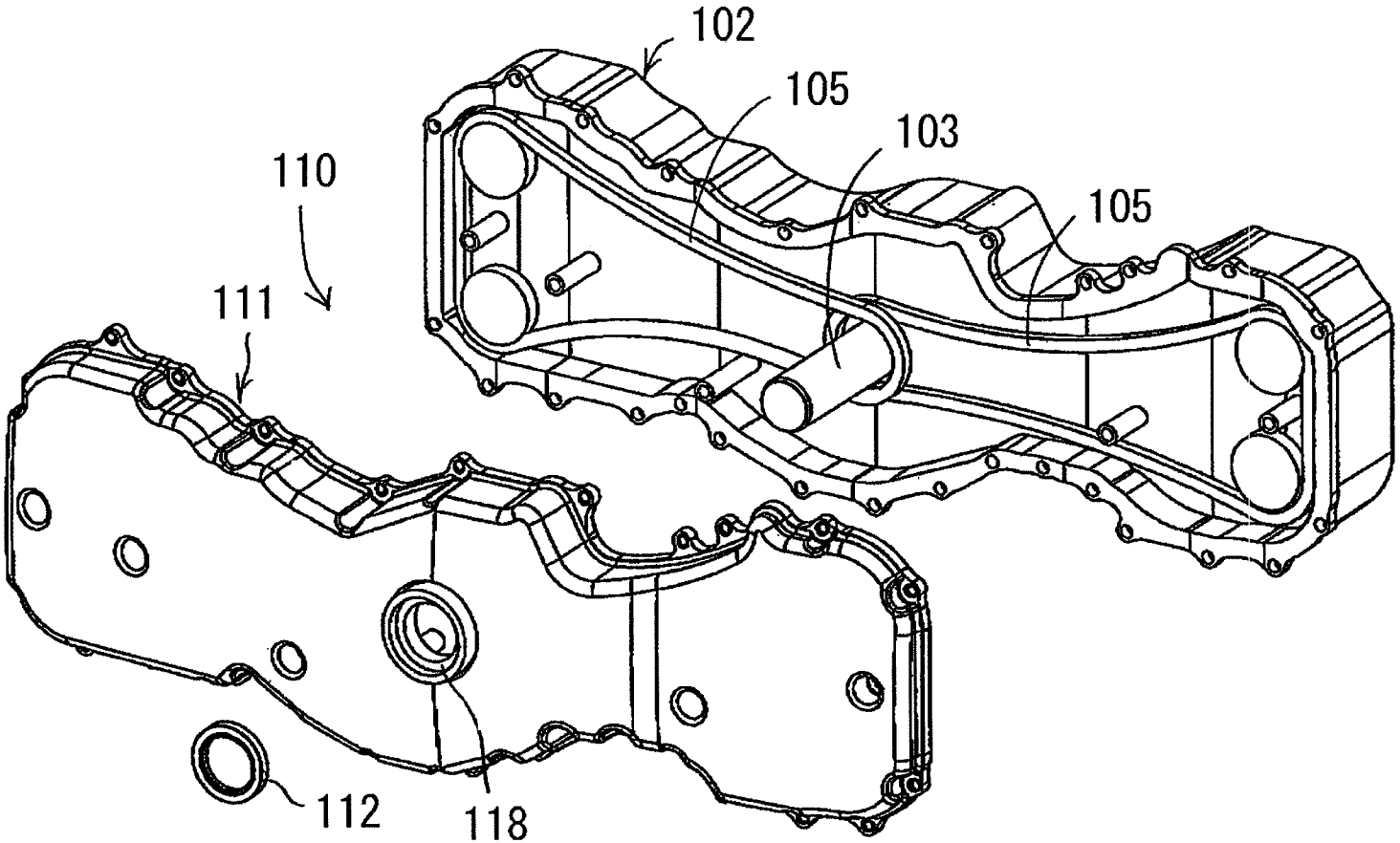
FIG. 19 is for describing a cover structure for an internal combustion engine according to a known technique.
Figure 20:
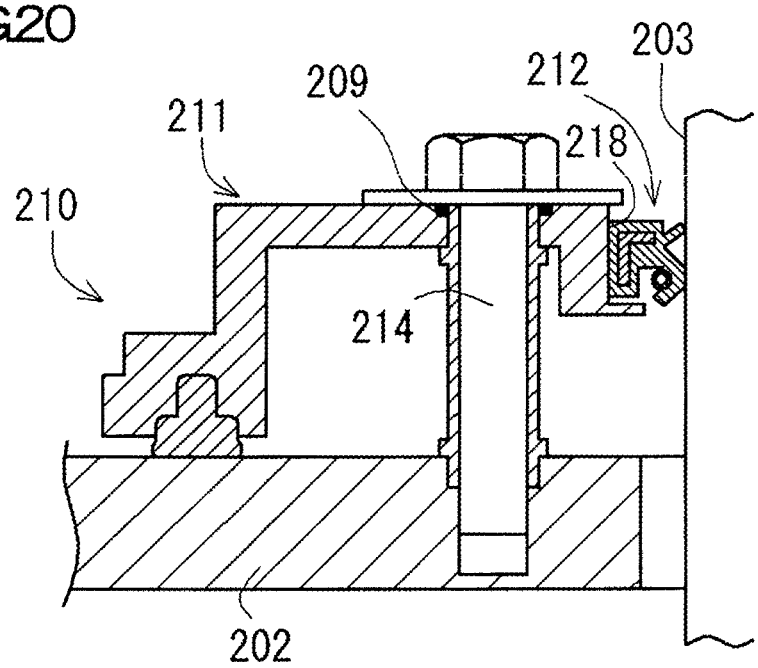
FIG. 20 is for describing another cover structure for an internal combustion engine according to a known technique.
Figure 21:
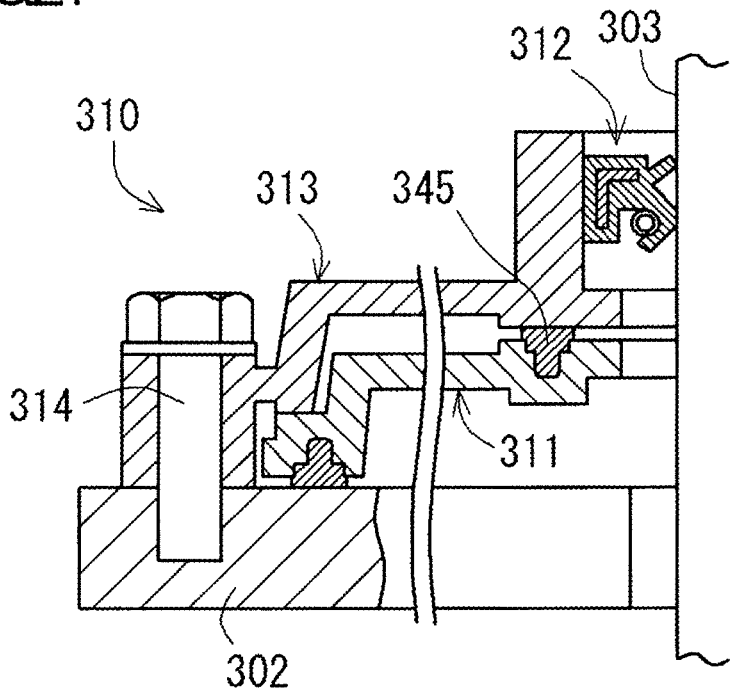
FIG. 21 is for describing still another cover structure for an internal combustion engine according to a known technique.

In the cover structure for an internal combustion engine according to this embodiment, for instance, the cover member (11) may include a projection (59) projecting into the inside of the insertion hole (18) to face or abut on the oil seal (12) held by the holding member (13) (see, e.g., FIG. 18).

Each numeral sign used in the parentheses for referring to each component of the above embodiment corresponds to each specific component as will be described below in the description of the examples.

EXAMPLES

In the following description, the invention will be described in detail by way of examples with reference to the attached drawings. In these examples, the "internal combustion engine" according to the invention is exemplified as a horizontally opposed engine for use in a vehicle (see FIG. 1).

As depicted in FIG. 1, the engine includes an engine body 2 made of a metal (e.g., aluminum alloy), and the engine body 2 includes, for example, a cylinder block, a cylinder head and a crank case. A first end of a crank shaft 3 (i.e., a shaft to take out the power for the engine) protrudes from the longitudinally central portion of the engine body 2. The crank shaft 3 and a sprocket 4 connected to a cam shaft (not depicted) are linked together by a power transmission 5 (e.g., timing chain, timing belt, gear). The cam shaft is a shaft including a cam configured to open and close the valves.

Example 1

(1) Cover Structure of Engine

As depicted in FIGS. 1 and 2, a cover structure 10 of the engine according to this Example covers and protects the power transmission 5 configured to transmit the power from the crank shaft 3 to the cam shaft in the engine. The cover 10 includes: a cover member 11 made of a plastic (e.g., polyamide resin) and attached to the engine body 2 so as to cover the power transmission 5; and a holding member 13 made of a metal (e.g., aluminum alloy) and configured to hold an oil seal 12 pressurized to the outer circumference of the crank shaft 3.

Figure 3:
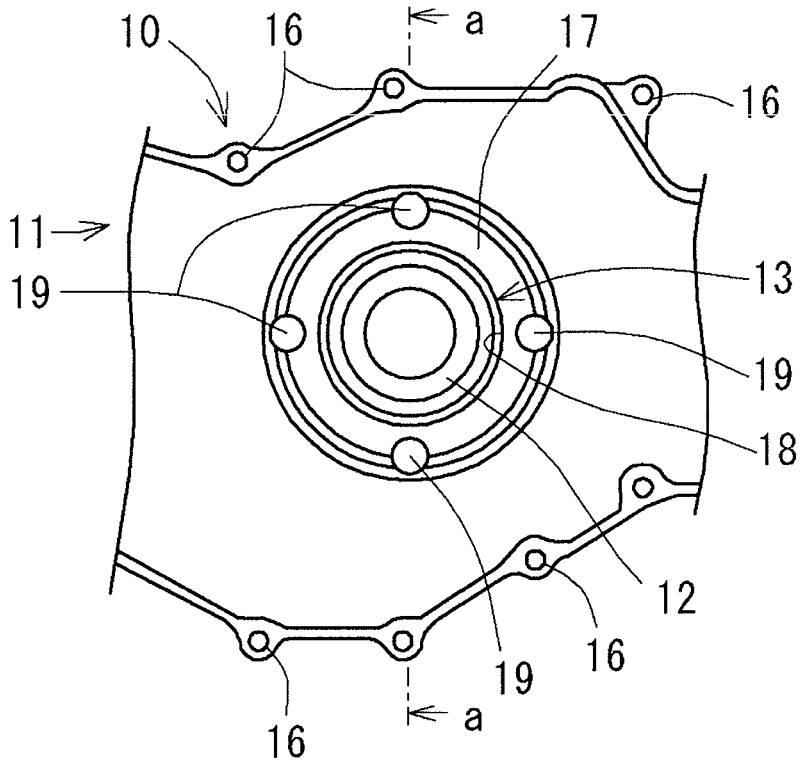
FIG. 3 is a front view depicting the primary portion of the cover structure.
Figure 4:
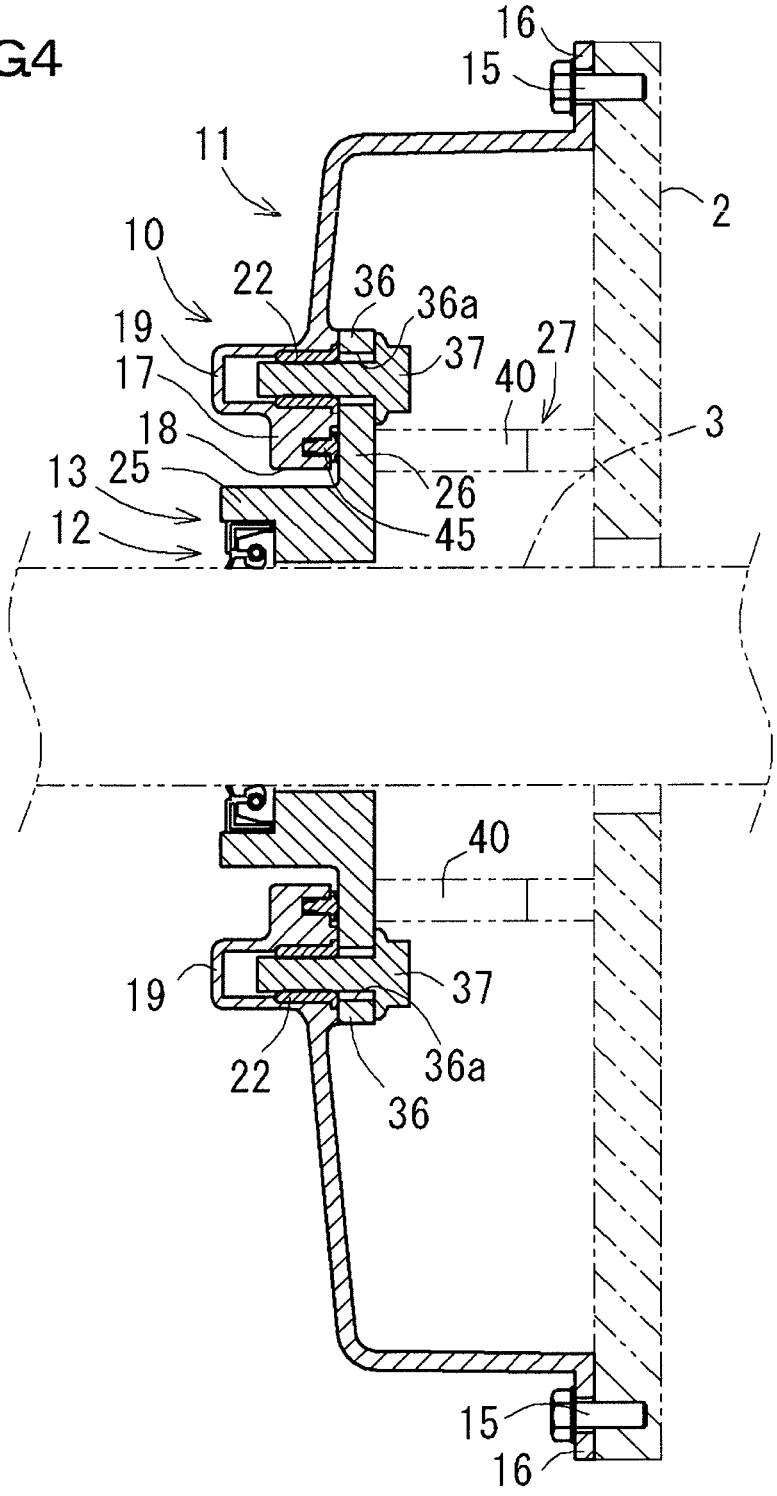
FIG. 4 is an enlarged view depicting a cross section taken along a line a-a in FIG. 3.

The cover member 11 has a shape of box; one side of the cover member 11 is open to cover a lateral side of the engine body 2. The open edge of the cover member 11 is provided with a plurality of fastening portions 16 configured to be fastened to the engine body 2 by a fastening bolt 15. As depicted in FIGS. 3 and 4, the longitudinally central portion of the cover member 11 is provided with a boss 17 raised toward the front side of the cover member 11 (i.e., the front side of the cover member 11 opposite to the engine body 2). The boss 17 is provided with an insertion hole 18 for the crank shaft 3. The boss 17 is also provided with a plurality of projections 19 (four projections in the depiction) projecting toward the front side of the cover member 11. The projections 19 are positioned along the circumference of the boss 17 at positions spaced apart from each other by a predetermined angle (e.g., spaced apart from each other by 90 degrees). Each projection 19 is provided with a recess 21 recessed from the back side of the cover member 11 (i.e., the back side of the cover member 11 facing the engine body 2) toward the front side of the cover member 11. Within the recess 21, a nut 22 screwed with the fastening bolt 37 is embedded by insert molding, heat press fitting or the like. As depicted in FIG. 5, the back side of the boss 17 is formed with an annular attachment groove 23 attached with a gasket 45 described later. The attachment groove 23 is positioned at a position inner with respect to the fastening bolt 37 in the radial direction of the crank shaft 3, to surround the crank shaft 3.

As depicted in FIGS. 5, 6A and 6B, the holding member 13 includes a tube 25, a flange 26 and a positioning portion 27. The tube 25 is configured to accept the insertion of the crank shaft 3 and to be insertable into the insertion hole 18 of the cover member 11. The inner circumference of the tube 25 is provided with an annular recess 31 at an axial end position. The recess 31 holds the oil seal 12 while pressuring the oil seal 12. The oil seal 12 includes: an elastic portion 32 made of a rubber or a plastic and provided with a lip 32*a* pressurized to the outer circumference of the crank shaft 3; a metal ring 33 supporting the elastic portion 32; and a spring 34 biasing the lip 32*a* toward the crank shaft 3.

The flange 26 is provided to the outer circumference of the tube 25 at an axial end position. The flange 26 covers the outer circumference of the insertion hole 18 of the cover member 11. The outer circumference of the flange 26 is provided with a plurality of projections 36 (four projections in the depiction) projecting in the centrifugal direction. The projections 36 are positioned along the circumference of the flange 26 at positions spaced apart from each other by a predetermined angle (e.g., spaced apart from each other by 90 degrees). Each projection 36 is provided with a through hole 36*a* penetrating through the projection 36 in the axial direction of the crank shaft 3. A shaft 37*a* of the fastening bolt 37 is inserted into the through hole 36*a* of the flange 26, and a thread 37*b* provided at a distal end of the shaft 37*a* is screwed into the nut 22 embedded in the cover member 11. Accordingly, the flange 26 is fastened to the cover member 11 by the plurality of fastening bolts 37.

As depicted in FIGS. 6A, 6B and 7A to 7C, the positioning portion 27 includes a plurality of rod-shaped legs 40 (four legs in the depiction) that extend from the flange 26 toward the engine body 2 in the axial direction of the crank shaft 3. The axially end surface of each leg 40 is provided with a fitting hole 41 bored in the axial direction of the crank shaft 3. The fitting hole 41 is fitted with a knock pin 42 erecting from the front side of the engine body 2. Hence, engagement of the positioning portion 27 with the engine body 2 (more specifically, fitting of the knock pins 42 with the distal ends of the plurality of legs 40) allows the holding member 37 to be positioned with respect to the axial direction of the crank shaft 3 and in the planar direction perpendicular to the axial direction.

The legs 40 are positioned along the circumference of the flange 26 at positions spaced apart from each other by a predetermined angle (e.g., spaced apart from each other by 90 degrees). However, the position, number and space of the leg 20 may be determined suitably in accordance with the layout of the structure on the side of the engine body 2.

As depicted in FIG. 4, the cover member 11 and the holding member 13 are fastened together by the fastening bolt 37 while interposing a gasket 45 positioned to surround the crank shaft 3. The gasket 45 is sandwiched between the axial end surface of the outer circumference of the insertion hole 18 of the cover member 11 and the front surface of the flange 26 of the holding member 13. The gasket 45 is also positioned to surround the crank shaft 3 at a position inner with respect to the fastening bolt 37 in the radial direction of the crank shaft 3 (i.e., position closer to the crank shaft 3 than the fastening bolt 37 in the radial direction of the crank shaft 3).

Figure 8:
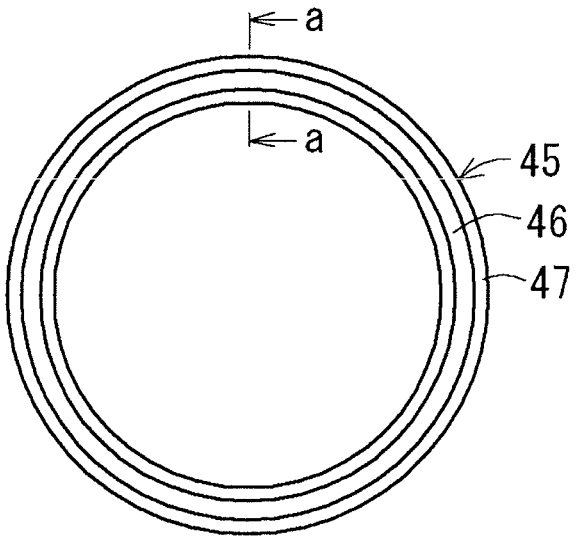
FIG. 8 is a front view of a gasket according to Example 1.
Figure 9:
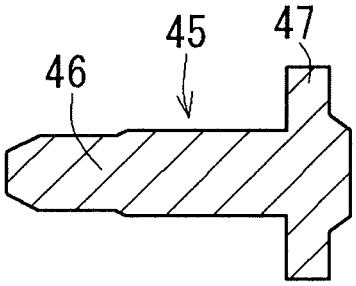
FIG. 9 is an enlarged view depicting a cross section taken along a line a-a in FIG. 8.

As depicted in FIGS. 8 and 9, the gasket 45 is made of a rubber, plastic or metal to exhibit an annular shape as the whole. The gasket 45 includes a ring 46 and a flange 47 expanding from the axial end of the ring 46 in the radial direction, and has a substantially T-shaped vertical cross section. The ring 46 is pressurized into the attachment groove 23 of the cover member 11, and the flange 47 is sandwiched between the back surface of the outer circumference of the insertion hole 18 of the cover member 11 and the front surface of the flange 26 of the holding member 13 (see FIG. 5).

Figure 10A:
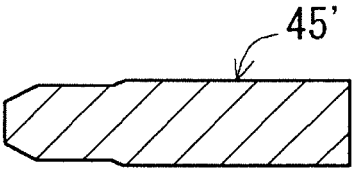
FIGS. 10A and 10B are for describing a gasket according to another embodiment, where
Figure 10B:
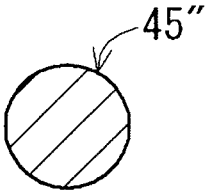

Although the gasket 45 has substantially T-shaped vertical cross section in Example described above, the gasket is not limited thereto. For instance, the gasket may be a gasket 45' having a substantially I-shaped vertical cross section (see FIG. 10A), or may be a gasket 45" having a substantially circular vertical cross section (see FIG. 10B).

(2) Assembly of Cover Structure of Engine

Next, a description will be given of the assembly of the above-configured cover structure 10 of the engine. As depicted in FIG. 2, the cover member 11 is prepared by embedding the nut 22 and attaching the gasket 45. Then, the tube 25 of the holding member 13 is inserted into the insertion hole 18 from the back side of the cover member 11. Subsequently, the shaft 37*a* of the fastening bolt 37 is inserted into the through hole 36*a* from the back side of the cover member 11, and thread 37*b* is screwed into the nut 22. Thereafter, the oil seal 12 is attached to the inner circumference of the tube 25 of the holding member 13 from the front side of the cover member 11, and the cover structure 10 is obtained in this manner.

In the cover structure 10 configured as above, the oil seal 12 seals the portion between the crank shaft 3 and the holding member 13, and the gasket 45 seals the portion between the cover member 11 and the holding member 13. This configuration prevents the leakage of the oil within the cover structure 10 to the outside. Further, the positioning member 27 of the holding member 13 is positioned by engaging with the engine body 2. With this configuration, the holding member 13 is accurately attached to the engine body 2, and the oil seal 12 is accurately pressurized onto the outer circumference of the crank shaft 3.

(3) Advantageous Effects of this Example

According to the cover structure 10 of the engine in this Example, the cover structure 10 includes: the plastic cover member 11 attached to the engine body 2 so as to cover the power transmission 5 and provided with the insertion hole 18 for the crank shaft 3; and the metallic holding member 13 configured to accept the insertion of the crank shaft 3 and also to hold the oil seal 12 pressurized to the outer circumference of the crank shaft 3. The holding member 13 is positionable by engaging with the engine body 2 with respect to the axial direction of the crank shaft 3 and the planar direction perpendicular to the axial direction. Further, the cover member 11 and the holding member 13 are fastened together by the fastening bolt 37 while interposing the gasket 45 positioned to surround the crank shaft 3. According to the above configuration, as the plastic cover member 11 and the metallic holding member 13 are used in combination and the metallic holding member 13 holds the portion for which the dimensional accuracy is required, the weight of the cover structure 10 as a whole is reduced. Further, the oil seal 12 is held by the metallic holding member 13, and the holding member 13 is positioned with respect to the axial direction of the crank shaft 3 and the planar direction perpendicular to the axial direction. Therefore, the configuration secures the sufficient sealing performance of the oil seal 12. Moreover, since the cover member 11 and the holding member 13 are directly fastened together by the fastening bolt 37, the gasket 45 is sufficiently pressurized, and the cover member 11 is prevented from being deformed due to creep, heat or pressure. Even if the cover member 11 is deformed due to creep, heat or pressure, the gasket 45 follows the deformation. As the result, the configuration secures the sufficient sealing performance of the gasket 45. Still further, irrespective of the position where the cover member 11 and the holding member 13 are fastened together by the fastening bolt 37, the engaging portion for positioning the holding member 13 with respect to the engine body 2 is suitably set. Therefore, even in the neighborhood of the crank shaft where the components such as sprocket and pulley are centralized, the holding member 13 is positioned and disposed.

In this Example, the holding member 13 includes the tube 25, the flange 26 and the positioning portion 27. With this configuration, the metallic holding member 13 reduces its size and weight, thereby further contributing to the weight reduction of the cover structure 10 as a whole.

In this Example, the gasket 45 is sandwiched between the outer circumference of the insertion hole 18 of the cover member 11 and the flange 26 of the holding member 13. With this configuration, the gasket 45 is disposed in the neighborhood of the fastening bolt 37, and thus the sealing performance of the gasket 45 is further enhanced.

In this Example, the tube 25 is inserted into the insertion hole 18 of the cover member 11. With this configuration, the holding member 13 further reduces its size, and the holding member 13 is more easily fastened to the cover member 11 by the fastening bolt 37.

In this Example, the plurality of fastening bolts 37 are positioned along the circumference of the flange 26 at positions spaced apart from each other by an equal angle. With this configuration, the gasket 45 is substantially uniformly pressurized in the circumferential direction. Further in this Example, the fastening bolt 37 is inserted from the back side of the cover member 11. Therefore, when detaching the cover member 11 from the engine body 2, the configuration prevents the fastening bolt 37 from being erroneously disengaged therefrom.

In this Example, the positioning portion 27 includes the plurality of rod-shaped legs 40. With this configuration, the holding member 13 further reduces its weight.

In this Example, the shaft 37*a* of the fastening bolt 37 is inserted into the through hole 36*a* formed in the holding member 13, and the thread 37*b* is screwed into the nut 22 embedded in the cover member 11. Also, the gasket 45 is positioned at a position inner with respect to the fastening bolt 37 in the radial direction of the crank shaft 3. With this configuration, without providing any separate sealing member between the fastening bolt 37 and the cover member 11, the gasket 45 seals the portion between the cover member 11 and the holding member 13. Therefore, the gasket 45 may further reduce its diameter.

Example 2

Next, a description will be given of a cover structure for an engine according to this Example 2. In the description of the cover structure of the engine according to this Example 2, substantially the same components as in the cover structure 10 of the engine according to Example 1 above will be allotted with the same numeral signs, and the detailed description thereof will be omitted. Also, the components that perform substantially the same functions as in the cover structure 10 of the engine will be allotted with the same numeric signs plus the indication of "A."

(1) Cover Structure of Engine

As depicted in FIG. 11, the cover structure 10A of the engine according to this Example includes: a cover member 11A made of a plastic (e.g., polyamide resin) and attached to the engine body 2 so as to cover the power transmission 5; and a holding member 13A made of a metal (e.g., aluminum alloy) and configured to hold the oil seal 12 pressurized to the outer circumference of the crank shaft 3.

Figure 12:
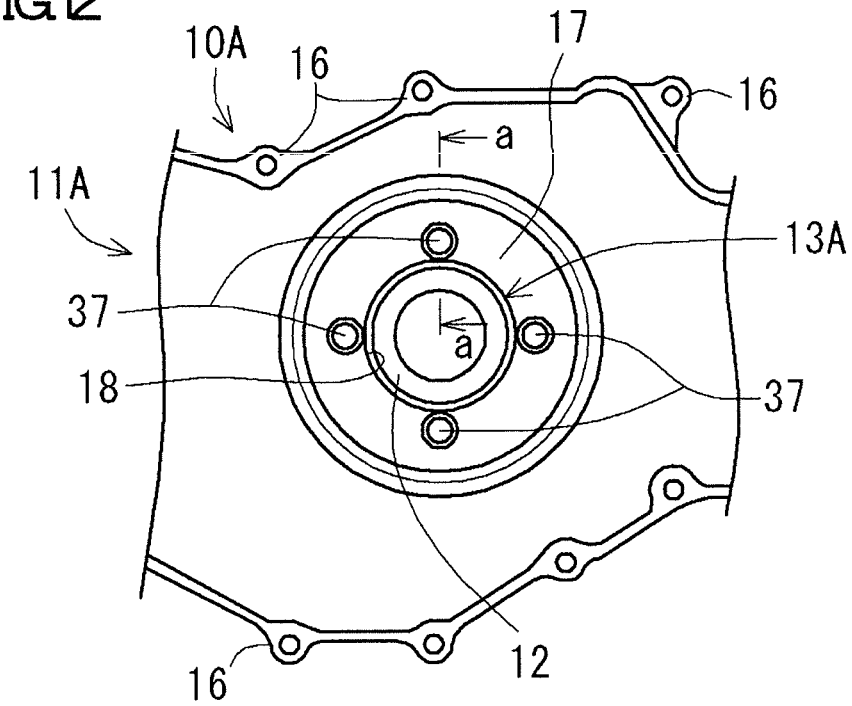
FIG. 12 is a front view depicting the primary portion of the cover structure.

The cover member 11A has a shape of box, and one side of the cover member 11A is open to cover a lateral side of the engine body 2. The open edge of the cover member 11A is provided with the plurality of fastening portions 16 configured to be fastened to the engine body 2 by the fastening bolt 15. Further, as depicted in FIGS. 12 and 13, the longitudinal central portion of the cover member 11A is provided with the boss 17 raised toward the back surface of the cover member 11A (i.e., the back surface of the cover member 11A that faces the engine body 2). The boss 17 is formed with the insertion hole 18 for the crank shaft 3. In addition, the boss 17 is provided with a plurality of through holes 51 (four through holes in the depiction) penetrating through the boss 17 in the axial direction of the crank shaft 3. These through holes 51 are positioned along the circumference of the boss 17 at positions spaced apart from each other by a predetermined angle (e.g., spaced apart from each other by 90 degrees). Into each through hole 51, the fastening bolt 37 is inserted via a tubular collar 52. The back surface of the boss 17 is provided with the annular attachment groove 23 to which the gasket 45 is attached. The attachment groove 23 is positioned at a position outer with respect to the fastening bolt 37 in the radial direction of the crank shaft 3 so as to surround the crank shaft 3.

The holding member 13A includes a tube 25A, a flange 26A and a positioning portion 27A. The tube 25A is configured to accept the insertion of the crank shaft 3 and to be insertable into the insertion hole 18 of the cover member 11. The inner circumference of the tube 25A is provided with the annular recess 31 at an axial end position. The recess 31 holds the oil seal 12 while pressurizing the oil seal 12.

The flange 26A is provided to the outer circumference of the tube 25A at an axial end position. The flange 26A covers the outer circumference of the insertion hole 18 of the cover member 11A. The front surface of the flange 26A is provided with a plurality of thread holes 53 (four thread holes in the depiction) bored in the axial direction of the crank shaft 3. The thread holes 53 are positioned along the circumference of the flange 26A at positions spaced apart from each other by a predetermined angle (e.g., spaced apart from each other by 90 degrees). The shaft 37*a* of the fastening bolt 37 is inserted into the through hole 51 formed in the cover member 11A, and the thread 37*b* formed at the distal end of the shaft 37*a* is screwed into the thread hole 53 formed in the holding member 13A. Accordingly, the flange 26A is fastened to the cover member 11A by the plurality of fastening bolts 37.

The positioning portion 27A includes the plurality of rod-shaped legs 40 (four legs in the depiction) extending from the flange 26A toward the engine body 2 in the axial direction of the crank shaft 3. As the positioning portion 27A is engaged with the engine body 2 (more specifically, the knock pins 42 are fitted with the distal ends of the plurality of legs 40), the holding member 13A is positioned with respect to the axial direction of the crank shaft 3 and in the planar direction perpendicular to the axial direction (see FIG. 7).

The cover member 11A and the holding member 13A are fastened together by the fastening bolt 37 while interposing the gasket 45 positioned to surround the crank shaft 3. The gasket 45 is sandwiched between the axial end surface of the outer circumference of the insertion hole 18 of the cover member 11A and the front surface of the flange 26A of the holding member 13A. The gasket 45 is also positioned to surround the crank shaft 3 at a position outer with respect to the fastening bolt 37 in the radial direction of the crank shaft 3 (i.e., position more away from the crank shaft 3 than the fastening bolt 37 in the radial direction of the crank shaft 3).

(2) Assembly of Cover Structure of Engine

Next, a description will be given of the assembly of the above-configured cover structure of the engine. As depicted in FIG. 11, the cover member 11A is prepared by attaching the gasket 45. Then, the tube 25A of the holding member 13A is inserted into the insertion hole 18 from the back side of the cover member 11A. Subsequently, the shaft 37*a* of the fastening bolt 37 is inserted into the through hole 51 from the front side of the cover member 11A, and thread 37*b* is screwed into the thread hole 53. Thereafter, the oil seal 12 is attached to the inner circumference of the tube 25A of the holding member 13A from the front side of the cover member 11A, and the cover structure 10A is obtained in this manner.

(3) Advantageous Effects of this Example

Operation and advantageous effects of the cover structure 10A of the engine in this Example are substantially the same as those of the cover structure 10 of the engine according to Example 1. The shaft 37*a* of the fastening bolt 37 is inserted into the through hole 51 formed in the cover member 11A, and the thread 37*b* is screwed into the thread hole 53 formed in the holding member 13A. The gasket 45 is positioned at a position outer with respect to the fastening bolt 37 in the radial direction of the crank shaft 3. Therefore, without providing any separate sealing member between the fastening bolt 37 and the cover member 11A, the gasket 45 seals the portion between the cover member 11A and the holding member 13A. Further, there is no need to embed the nut into the cover member 11A, and the workability is enhanced.

Example 3

Next, a description will be given of a cover structure for an engine according to this Example 3. In the description of the cover structure of the engine according to this Example 3, substantially the same components as in the cover structure 10 of the engine according to Example 1 above will be allotted with the same numeral signs, and the detailed description thereof will be omitted. Also, the components that perform substantially the same functions as in the cover structure 10 of the engine will be allotted with the same numeric signs plus the indication of "B."

(1) Cover Structure of Engine

As depicted in FIG. 14, the cover structure 10B of the engine according to this Example includes: a cover member 11B made of a plastic (e.g., polyamide resin) and attached to the engine body 2 so as to cover the power transmission 5; and a holding member 13B made of a metal (e.g., aluminum alloy) and configured to hold the oil seal 12 pressurized to the outer circumference of the crank shaft 3.

Figure 15:
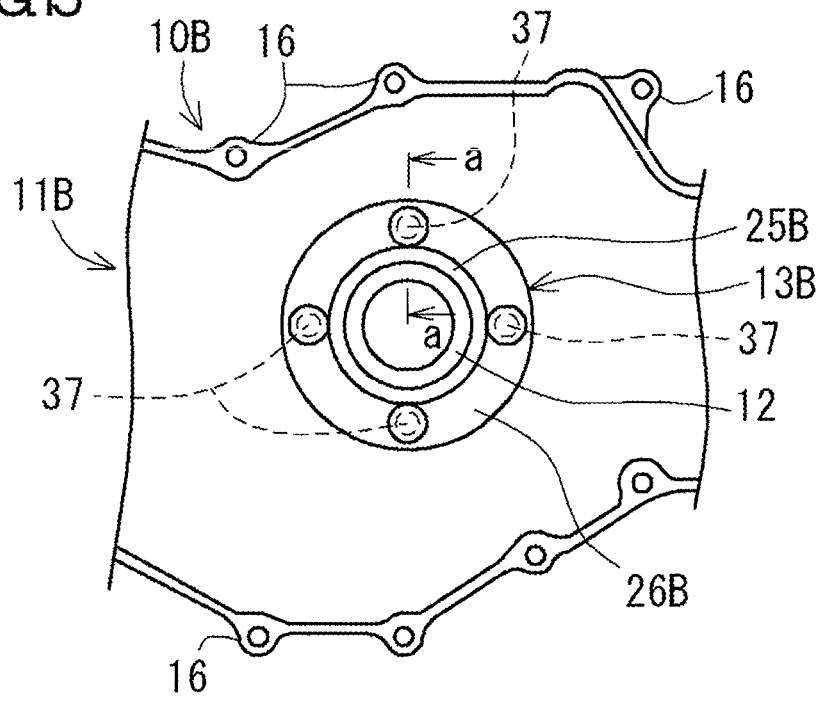
FIG. 15 is a front view depicting the primary portion of the cover structure.

The cover member 11B has a shape of box, and one side of the cover member 11B is open to cover a lateral side of the engine body 2. The open edge of the cover member 11B is provided with a plurality of fastening portions 16 configured to be fastened to the engine body 2 by a fastening bolt 15. Further, as depicted in FIGS. 15 and 16, the longitudinal central portion of the cover member 11B is provided with the boss 17 raised toward the front surface of the cover member 11B (i.e., the front surface of the cover member 11B opposite to the engine body 2). The boss 17 is provided with the insertion hole 18 for the crank shaft 3. In addition, the boss 17 is provided with a plurality of through holes 55 (four through holes in the depiction) penetrating through the boss 17 in the axial direction of the crank shaft 3. These through holes 55 are positioned along the circumference of the boss 17 at positions spaced apart from each other by a predetermined angle (e.g., spaced apart from each other by 90 degrees). Into each through hole 55, the fastening bolt 37 is inserted via a tubular collar 56. The front surface of the boss 17 is provided with the annular attachment groove 23 to which the gasket 45 is attached. The attachment groove 23 is positioned at a position outer with respect to the fastening bolt 37 in the radial direction of the crank shaft 3 so as to surround the crank shaft 3.

The holding member 13B includes the tube 25B, the flange 26B and the positioning portion 27B. The tube 25B is configured to accept the insertion of the crank shaft 3 and to be insertable into the insertion hole 18 of the cover member 11B. The inner circumference of the tube 25B is provided with an annular recess 31 at an axial end portion. The recess 31 holds the oil seal 12 while pressurizing the oil seal 12.

The flange 26B is provided to the outer circumference of the tube 25B at an axial end position. The flange 26B covers the outer circumference of the insertion hole 18 of the cover member 11B. The back surface of the flange 26B is provided with a plurality of thread holes 57 (four thread holes in the depiction) bored in the axial direction of the crank shaft 3. The thread holes 57 are positioned along the circumference of the flange 26B at positions spaced apart from each other by a predetermined angle (e.g., spaced apart from each other by 90 degrees). The shaft 37*a* of the fastening bolt 37 is inserted into the through hole 55 formed in the cover member 11B, and the thread 37*b* formed at the distal end of the shaft 37*a* is screwed into the thread hole 57 formed in the holding member 13B. Accordingly, the flange 26B is fastened to the cover member 11B by the plurality of fastening bolts 37.

The positioning portion 27B includes the plurality of rod-shaped legs 40 (four legs in the depiction) extending from the flange 26B toward the engine body 2 in the axial direction of the crank shaft 3. As the positioning portion 27B is engaged with the engine body 2 (more specifically, the knock pins 42 are fitted with the distal ends of the plurality of legs 40), the holding member 13B is positioned with respect to the axial direction of the crank shaft 3 and in the planar direction perpendicular to the axial direction (see FIGS. 7A to 7C).

The cover member 11B and the holding member 13B are fastened together by the fastening bolt 37 while interposing the gasket 45 positioned to surround the crank shaft 3. The gasket 45 is sandwiched between the axial end surface of the outer circumference of the insertion hole 18 of the cover member 11B and the front surface of the flange 26B of the holding member 13B. The gasket 45 is also positioned to surround the crank shaft 3 at a position outer with respect to the fastening bolt 37 in the radial direction of the crank shaft 3 (i.e., position more away from the crank shaft 3 than the fastening bolt 37 in the radial direction of the crank shaft 3).

(2) Assembly of Cover Structure of Engine

Next, a description will be given of the assembly of the above-configured cover structure 10B of the engine. As depicted in FIG. 14, the cover member 11B is prepared by attaching the gasket 45. Then, the tube 25B of the holding member 13B is inserted into the insertion hole 18 from the front side of the cover member 11B. Subsequently, the shaft 37*a* of the fastening bolt 37 is inserted into the through hole 55 from the back side of the cover member 11B, and thread 37*b* is screwed into the thread hole 57. Thereafter, the oil seal 12 is attached to the inner circumference of the tube 25B of the holding member 13B from the front side of the cover member 11B, and the cover structure 10B is obtained in this manner.

(3) Advantageous Effects of this Example

Operation and advantageous effects of the cover structure 10B of the engine in this Example are substantially the same as those of the cover structure 10 of the engine according to Example 1. The shaft 37*a* of the fastening bolt 37 is inserted into the through hole 55 formed in the cover member 11B, and the thread 37*b* is screwed into the thread hole 57 formed in the holding member 13B. The gasket 45 is positioned at a position outer with respect to the fastening bolt 37 in the radial direction of the crank shaft 3. Therefore, without providing any separate sealing member between the fastening bolt 37 and the cover member 11B, the gasket 45 seals the portion between the cover member 11B and the holding member 13B. Further, there is no need to embed the nut into the cover member 11B, and the workability is enhanced.

This invention is not limited to Examples as described above, but various modifications may be made within the scope of the invention in accordance with the purpose and the usage, and such modification may be employed as an example of this invention. More specifically, while exemplarily in Examples 1 to 3 above, the gasket 45 is sandwiched between the axial end surface of the outer circumference of the insertion hole 18 of the cover member 11, 11A, 11B and the front surface of the flange 26, 26A, 26B of the holding member 13, 13A, 13B, the configuration is not limited thereto. For instance, as depicted in FIG. 17, the gasket 45 may be sandwiched between the inner circumference of the insertion hole 18 of the cover member 11 and the outer circumference of the tube 25 of the holding member 13 inserted into the insertion hole 18. In the above configuration, since the gasket 45 forms the shaft sealing, the holding member 13 and even the oil seal 12 are easily centered at the center position due to the centering function of the gasket 45. The gasket 45 may be, for instance, attached to the annular attachment groove 23 formed in the outer circumference of the tube 25.

While exemplarily in Examples 1 to 3 above, the first end of the oil seal 12 held by the holding member 13, 13A, 13B is open, but the configuration is not limited thereto. For instance, as depicted in FIG. 18, the cover structure may further include a projection 59 projecting into the inside of the insertion hole 18 to axially face or abut on the oil seal 12 held by the holding member 13. In this configuration, the projection 59 prevents the disengagement of the oil seal 12 from the holding member 13. The projection 59 may be, for instance, shaped like a flange or like a projecting piece.

While exemplarily in Examples 1 to 3 above, the thread 37*b* is provided at the first end of the shaft 37*a* in the fastening bolt 37, the configuration is not limited thereto. For example, the fastening bolt may be a stud bolt, the shaft of which includes threads at its both ends. Further, while exemplarily in Examples 1 to 3 above, the thread 37*b* of the fastening bolt 37 is screwed without penetrating through the cover member 11, 11A, 11B or the holding member 13, 13A, 13B, the configuration is not limited thereto. For instance, the thread 37*b* of the fastening bolt 37 may penetrate through the cover member 11, 11A, 11B or the holding member 13, 13A, 13B so as to be screwed into the nut.

While exemplarily in Examples 1 to 3 above, the tube 25, 25A, 25B is inserted into the insertion hole 18 of the cover member 11, 11A, 11B, the configuration is not limited thereto. For instance, without insertion into the insertion hole 18 of the cover member 11, 11A, 11B, the tube may be positioned to abut on the outer circumference of the insertion hole 18 of the cover member 11, 11A, 11B.

While exemplarily in Examples 1 to 3 above, the positioning portion 27, 27A, 27B extends from the flange 26, 26A, 26B, the configuration is not limited thereto. For instance, the positioning portion may extend from the tube 25, 25A, 25B. Further, while exemplarily in Examples 1 to 3 above, the positioning portion 27, 27A, 27B includes the plurality of rod-shaped legs 40, the configuration is not limited thereto. For instance, a tubular positioning portion may be used.

While exemplarily in Examples 1 to 3, the cover member 11, 11A, 11B and the holding member 13, 13A, 13B are fastened together, and then the oil seal 12 is held by the holding member 13, 13A, 13B, the configuration is not limited thereto. For instance, the holding member 13, 13A, 13B may hold the oil seal 12, and then the cover member 11, 11A, 11B and the holding member 13, 13A, 13B may be fastened together.

While exemplarily in Example 3 above, the holding member 13B is set from the front side of the cover member 11B, and the cover member 11B and the holding member 13B are fastened by the fastening bolt 37 from the back side of the cover member 11B, the configuration is not limited thereto. For instance, the holding member 13B may be set from the front side of the cover member 11B, and the cover member 11B and the holding member 13B may be fastened by the fastening bolt 37 from the front side of the cover member 11B. With this configuration, without detaching the cover member 11B from the engine body 2, the holding member 13B may only be detached therefrom.

While exemplarily in Examples 1 to 3 above, the internal combustion engine is a horizontally opposed engine for use in a vehicle, the configuration is not limited thereto. For instance, the internal combustion engine may be a linear engine, a V-engine or a rotary engine. Alternatively, the internal combustion engine may be a gasoline engine or a diesel engine. Further alternatively, the internal combustion engine may be a motor for serving the power to equipment and devices other than a vehicle.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

This invention is widely applicable as a cover structure for covering and protecting the power transmission of the internal combustion engine. Particularly, this invention is preferably applicable as a cover structure for covering and protecting the power transmission of the engine in a vehicle such as automobile, bus and truck.

What is claimed is:

1. A cover structure for an internal combustion engine, the cover structure covering a power transmission configured to transmit power from a crank shaft to a cam shaft in the internal combustion engine, the cover structure comprising:

a plastic cover member attached to a body of the internal combustion engine so as to cover the power transmission and provided with an insertion hole for the crank shaft; and a metallic holding member configured to accept insertion of the crank shaft and to hold an oil seal pressurized to an outer circumference of the crank shaft, wherein the holding member is positionable by engaging with the body of the internal combustion engine with respect to an axial direction of the crank shaft and a planar direction perpendicular to the axial direction, and the cover member and the holding member are fastened together by a fastening bolt while interposing a gasket positioned to surround the crank shaft, wherein the holding member includes a tube configured to accept the insertion of the crank shaft, and wherein the tube is inserted into the insertion hole of the cover member.

2. A cover structure for an internal combustion engine, the cover structure covering a power transmission configured to transmit power from a crank shaft to a cam shaft in the internal combustion engine, the cover structure comprising:

a plastic cover member attached to a body of the internal combustion engine so as to cover the power transmission and provided with an insertion hole for the crank shaft; and a metallic holding member configured to accept insertion of the crank shaft and to hold an oil seal pressurized to an outer circumference of the crank shaft, wherein the holding member is positionable by engaging with the body of the internal combustion engine with respect to an axial direction of the crank shaft and a planar direction perpendicular to the axial direction, and the cover member and the holding member are fastened together by a fastening bolt while interposing a gasket positioned to surround the crank shaft, wherein the holding member includes: a tube configured to accept the insertion of the crank shaft and to hold the oil seal at an inner circumferential position; a flange provided to an outer circumference of the tube and fastened by the fastening bolt to an outer circumference of the insertion hole of the cover member; and a positioning portion extending from the flange and/or the tube in the axial direction of the crank shaft and engaging with the body of the internal combustion engine.

3. The cover structure for an internal combustion engine according to claim 2, wherein the gasket is sandwiched between the outer circumference of the insertion hole of the cover member and the flange of the holding member.

4. The cover structure for an internal combustion engine according to claim 2, wherein the gasket is sandwiched between the insertion hole of the cover member and the tube of the holding member inserted into the insertion hole.

5. The cover structure for an internal combustion engine according to claim 2, wherein the tube is inserted into the insertion hole of the cover member.

6. The cover structure for an internal combustion engine according to claim 2, wherein the fastening bolt includes a plurality of fastening bolts positioned along a circumferential direction of the flange.

7. The cover structure for an internal combustion engine according to claim 2, wherein the positioning portion includes a plurality of rod-shaped legs.

8. A cover structure for an internal combustion engine, the cover structure covering a power transmission configured to transmit power from a crank shaft to a cam shaft in the internal combustion engine, the cover structure comprising:

a plastic cover member attached to a body of the internal combustion engine so as to cover the power transmission and provided with an insertion hole for the crank shaft; and a metallic holding member configured to accept insertion of the crank shaft and to hold an oil seal pressurized to an outer circumference of the crank shaft, wherein the holding member is positionable by engaging with the body of the internal combustion engine with respect to an axial direction of the crank shaft and a planar direction perpendicular to the axial direction, and the cover member and the holding member are fastened together by a fastening bolt while interposing a gasket positioned to surround the crank shaft, wherein a shaft of the fastening bolt is inserted into a through hole penetrating through the holding member in the axial direction of the crank shaft, a thread provided at a distal end of the shaft is screwed into a nut embedded in the cover member, and the gasket is positioned at a position inner with respect to the fastening bolt in a radial direction of the crank shaft.

9. A cover structure for an internal combustion engine, the cover structure covering a power transmission configured to transmit power from a crank shaft to a cam shaft in the internal combustion engine, the cover structure comprising:

a plastic cover member attached to a body of the internal combustion engine so as to cover the power transmission and provided with an insertion hole for the crank shaft; and a metallic holding member configured to accept insertion of the crank shaft and to hold an oil seal pressurized to an outer circumference of the crank shaft, wherein the holding member is positionable by engaging with the body of the internal combustion engine with respect to an axial direction of the crank shaft and a planar direction perpendicular to the axial direction, and the cover member and the holding member are fastened together by a fastening bolt while interposing a gasket positioned to surround the crank shaft, wherein a shaft of the fastening bolt is inserted into a through hole penetrating through the cover member in the axial direction of the crank shaft, a thread provided at a distal end of the shaft is screwed into a thread hole formed in the holding member, and the gasket is positioned at a position outer with respect to the fastening bolt in a radial direction of the crank shaft.

10. The cover structure for an internal combustion engine according to claim 1, wherein the cover member includes a projection projecting into an inside of the insertion hole to face or abut on the oil seal held by the holding member.

* * * * *